US008004382B2

(12) United States Patent
Mashino

(10) Patent No.: US 8,004,382 B2
(45) Date of Patent: Aug. 23, 2011

(54) INDUCTOR DEVICE, AND METHOD OF MANUFACTURING THE SAME

(75) Inventor: Naohiro Mashino, Nagano (JP)

(73) Assignee: Shinko Electric Industries Co., Ltd., Nagano-Shi (JP)

( * ) Notice: Subject to any disclaimer, the term of this patent is extended or adjusted under 35 U.S.C. 154(b) by 0 days.

(21) Appl. No.: 12/708,829

(22) Filed: Feb. 19, 2010

(65) Prior Publication Data

US 2010/0231344 A1 Sep. 16, 2010

(30) Foreign Application Priority Data

Mar. 11, 2009 (JP) ..... 2009-057414

(51) Int. Cl.
*H01F 5/00* (2006.01)

(52) U.S. Cl. ..... 336/200; 336/223; 29/602.1

(58) Field of Classification Search ..... 336/200, 336/223, 232; 29/902.1
See application file for complete search history.

(56) References Cited

U.S. PATENT DOCUMENTS

| | | | | |
|---|---|---|---|---|
| 5,583,474 | A | 12/1996 | Mizoguchi | |
| 5,801,521 | A | 9/1998 | Mizoguchi | |
| 6,404,317 | B1 | 6/2002 | Mizoguchi | |
| 6,593,841 | B1 | 7/2003 | Mizoguchi | |
| 6,724,290 | B1 * | 4/2004 | Ohnmacht et al. | 336/200 |
| 2007/0030659 | A1 * | 2/2007 | Suzuki et al. | 361/793 |
| 2008/0011612 | A1 * | 1/2008 | Takai et al. | 205/136 |
| 2008/0081155 | A1 * | 4/2008 | Kaneda et al. | 428/172 |
| 2009/0183358 | A1 * | 7/2009 | Jow et al. | 29/602.1 |

FOREIGN PATENT DOCUMENTS

| | | | |
|---|---|---|---|
| JP | 6-132131 | | 5/1994 |
| JP | 11-354323 | | 12/1999 |
| JP | 2001-102235 | A1 | 4/2001 |
| JP | 2002-80973 | A1 | 3/2002 |
| JP | 2008-10695 | A1 | 1/2008 |
| JP | 2008-205179 | A1 | 9/2008 |

* cited by examiner

*Primary Examiner* — Anh T Mai
(74) *Attorney, Agent, or Firm* — Kratz, Quintos & Hanson, LLP

(57) ABSTRACT

An inductor device includes a first magnetic body pattern layer in which slits are provided and which is made to a pattern, a lower insulating layer formed on the first magnetic body pattern layer, a planar coil layer formed on the lower insulating layer, an upper insulating layer formed on the planar coil layer, and a second magnetic body pattern layer formed on the upper insulating layer and in which slits are provided and which is made to a pattern, wherein the first magnetic body pattern layer and the second magnetic body pattern layer are arranged to intersect orthogonally with the planar coil layer.

8 Claims, 13 Drawing Sheets

INDUCTOR DEVICE, AND METHOD OF MANUFACTURING THE SAME

CROSS-REFERENCE TO RELATED APPLICATIONS

This application is based on and claims priority of Japanese Patent Application No. 2009-057414 filed on Mar. 11, 2009, the entire contents of which are incorporated herein by reference.

BACKGROUND OF THE INVENTION

1. Field of the Invention

The present invention relates to an inductor device and a method of manufacturing the same and, more particularly, an inductor device including such a structure that a planar type inductor is formed on a wiring substrate, or the like and a method of manufacturing the same.

2. Description of the Related Art

In the prior art, there is the inductor device which is used in the high-frequency circuit, and the like in various electronic equipments. As the structure of the inductor, there is the winding wire type in which the electrical wire is wound, or the planar type in which the spiral coil conductor is formed on a plane, and the like.

In Patent Literature 1 (Patent Application Publication (KOKAI) 2001-102235), the planar type magnetic element is disclosed, and it is set forth that the magnetic element is constructed by stacking the insulating layer and the magnetic body layer on the planar coil in which the groove portion between adjacent coil conductors has a groove aspect ratio of 1 or more.

In Patent Literature 2 (Patent Application Publication (KOKAI) 2008-10695, Patent Literature 3 (Patent Application Publication (KOKAI) Hei 6-132131), Patent Literature 4 (Patent Application Publication (KOKAI) Hei 11-354323), and Patent Literature 5 (Patent Application Publication (KOKAI) 2008-205179), it is set forth that a high-frequency loss is reduced by providing the slits to the magnetic layer in the inductor. For more detail, in Patent Literature 2, it is disclosed that the substantially <-shaped slit that spreads from the bending portion to the outer peripheral direction is provided to the magnetic body layer. In Patent Literature 3, it is disclosed that the slits of the magnetic thin film are provided in parallel with the direction along which the coil conductor extends.

Also, in Patent Literature 6 (Patent Application Publication (KOKAI) 2002-80973), it is set forth that, in the method of forming the fine pattern plating film having the soft magnetic characteristic by the electroless plating, such a method is described that minute amount of organic stabilizer is added into the electroplating bath so as to form a homogeneous electroless plating film in the pattern portion, and the impurities in the plating bath are removed and also the adequate stirring is applied continuously.

In the case that the inductor component of the winding wire type is mounted on the wiring substrate, a height and a mounting area must be secured to some extent and thus a size reduction is restricted. Also, a cost of such inductor component is relatively high, and thus it is possible that an increase in production cost is caused.

Further, in order to make the inductor component respond to the higher frequency trend, the special structure is needed, e.g., the air core structure is required, or the like. Hence, an additional cost is required to design the dedicated component.

As the countermeasures for this, in order to attain a size reduction and a cost reduction of the electronic equipment, there is the method that the inductor element is built into the wiring substrate. However, according to this method, such problems existed that the EMI (undesirable radiation) noise is emitted from the inductor element or the sufficient characteristics of the inductor element cannot be obtained, so that the reliability of the inductor element is not always satisfactory.

As a result, the technology to build the highly reliable inductor element having the desired characteristics into the wiring substrate is earnestly desired.

SUMMARY OF THE INVENTION

It is an object of the present invention to provide an inductor device that can be formed to make the inductor element with high reliability build in, and a method of manufacturing the same.

The present invention is concerned with an inductor device, which includes a first magnetic body pattern layer in which slits are provided and which is made to a pattern; a lower insulating layer formed on the first magnetic body pattern layer; a planar coil layer formed on the lower insulating layer; an upper insulating layer formed on the planar coil layer; and a second magnetic body pattern layer formed on the upper insulating layer, and in which slits are provided and which is made to a pattern; wherein the first magnetic body pattern layer and the second magnetic body pattern layer are arranged to intersect orthogonally with the planar coil layer.

In the inductor device of the present invention, the first and second magnetic body pattern layers (such as the Ni Co layer, or the like) are arranged to the upper and lower side of the planar coil layer, and the first and second magnetic body pattern layers are made to patterns by providing slits. Accordingly, in the case that this inductor device is applied to the printed-wiring board, or the like, the EMI noise is reduced and high reliability can be assured, and also an inductance can be increased. Also, since the first and second magnetic body pattern layers are arranged to intersect orthogonally with the planar coil layer, generation of the eddy current can be suppressed in contrast to the case where the pattern layers do not intersect orthogonally with the planar coil layer.

Also, in the inductor device of the present invention, the inductor element is built into the substrate, or the like by the thin film processing. Therefore, a thinner type of the inductor device can be attained rather than the case where the inductor component whose height is high is mounted. Also, since the planar coil layer can be stacked, a mounting area can be reduced rather than the case where the inductor component is mounted.

Also, even when the inductor device is applied to the high-frequency circuit, there is no necessity that the inductor component which is designed particularly for high-frequency purpose should be employed. Therefore, a manufacturing cost can be reduced.

In the preferred mode of the present invention, the magnetic body pattern layer is formed selectively on the catalyst metal-containing resin pattern layer, which is patterned by the photolithography, by the electroless plating.

By employing the above approach, the magnetic body pattern layer which is patterned and has arbitrary film thickness can be formed easily on the catalyst metal-containing resin pattern layer by the electroless plating, without etching the magnetic body layer having film property that is hard to etch.

As explained above, the inductor device of the present invention can be formed to make the inductor element with high reliability built in.

DETAILED DESCRIPTION OF THE PREFERRED EMBODIMENTS

Embodiments of the present invention will be explained with reference to the accompanying drawings hereinafter.

First Embodiment

FIG. 1 to FIG. 12 are plan views and sectional views showing a method of manufacturing an inductor device according to a first embodiment of the present invention respectively. In FIG. 1 to FIG. 12, upper views are a plan view respectively, and lower views are a sectional view respectively.

Figure 1:
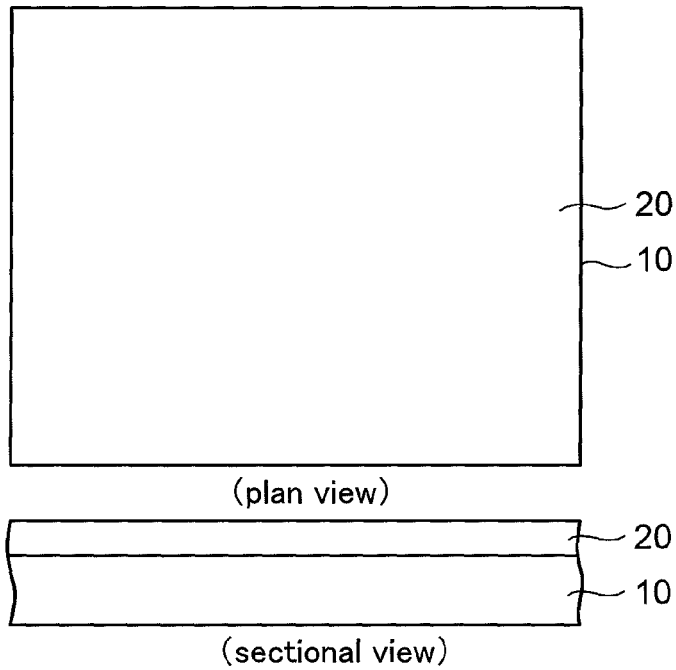
FIG. 1 is a plan view and a sectional view (#1) showing a method of manufacturing an inductor device according to a first embodiment of the present invention.

In the method of manufacturing the inductor device in the first embodiment, as shown in FIG. 1, first, a first insulating layer 20 is formed on a substrate 10. The first insulating layer 20 is formed of an epoxy resin or a polyimide resin, and that thickness is set to 20 to 200 μm. The first insulating layer 20 is formed by either pasting a resin film on the substrate 10 or coating a liquid resin on the substrate 10.

Preferably the substrate 10 is the wiring substrate having the wiring layer. As described later, the inductor element connected to the wiring layer is built-in over the substrate 10.

Figure 2:
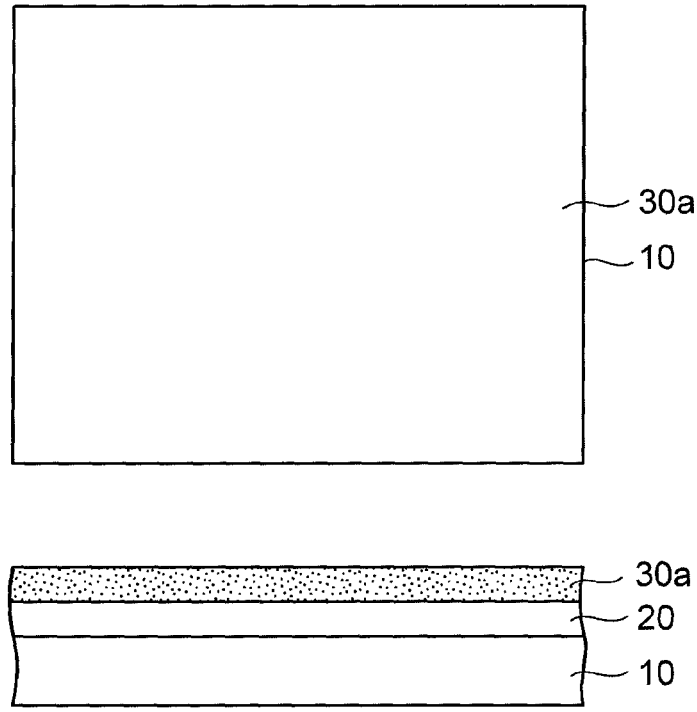
FIG. 2 is a plan view and a sectional view (#2) showing the method of manufacturing the inductor device according to the first embodiment of the present invention.

Then, as shown in FIG. 2, a photosensitive catalyst metal-containing resin layer 30*a* whose film thickness is 2 to 20 μm (preferably, about 5 μm) is formed on the first insulating layer 20. The catalyst metal-containing resin layer 30*a* is constructed by dispersing palladium or the like, which acts as the catalyst of the electroless plating, into the epoxy resin, or the like.

As the method of forming the catalyst metal-containing resin layer 30*a*, there is either the method of coating a liquid resin impregnated with palladium or the method of pasting a resin film impregnated with palladium.

Figure 3:
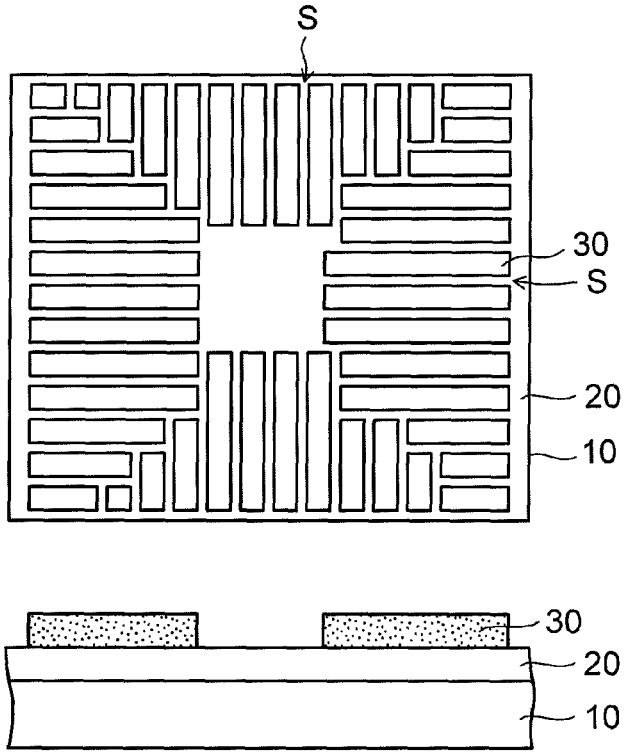
FIG. 3 is a plan view and a sectional view (#3) showing the method of manufacturing the inductor device according to the first embodiment of the present invention.

Then, as shown in FIG. 3, the catalyst metal-containing resin layer 30*a* is exposed via a photo mask, and then is developed. Accordingly, the catalyst metal-containing resin layer 30*a* is patterned and thus a first catalyst metal-containing resin pattern layers 30 are obtained.

The first catalyst metal-containing resin pattern layers 30 are patterned by providing a slit S between them respectively. In both sides of the lateral direction of the substrate 10, the first catalyst metal-containing resin pattern layers 30 are arranged side by side in a state that their longer directions are directed to the lateral direction. Also, in both sides of the longitudinal direction of the substrate 10, the first catalyst metal-containing resin pattern layers 30 are arranged side by side in a state that their longer directions are directed to the longitudinal direction.

Then, the first catalyst metal-containing resin pattern layers 30 are not arranged in the center portion of the substrate 10, and it is in the state where the first insulating layer 20 is exposed collectively with a square shape from the center portion.

In this manner, the first catalyst metal-containing resin pattern layers 30 are arranged side by side in a state that their longer directions are directed to the lateral direction and the longitudinal direction such that the center portion is surrounded, and the first catalyst metal-containing resin pattern layers 30 are separated mutually by providing the slit S between them respectively. In this case, a plurality of first catalyst metal-containing resin pattern layers 30 may be connected via a connection portion in a state that the slits S are provided.

Figure 4:
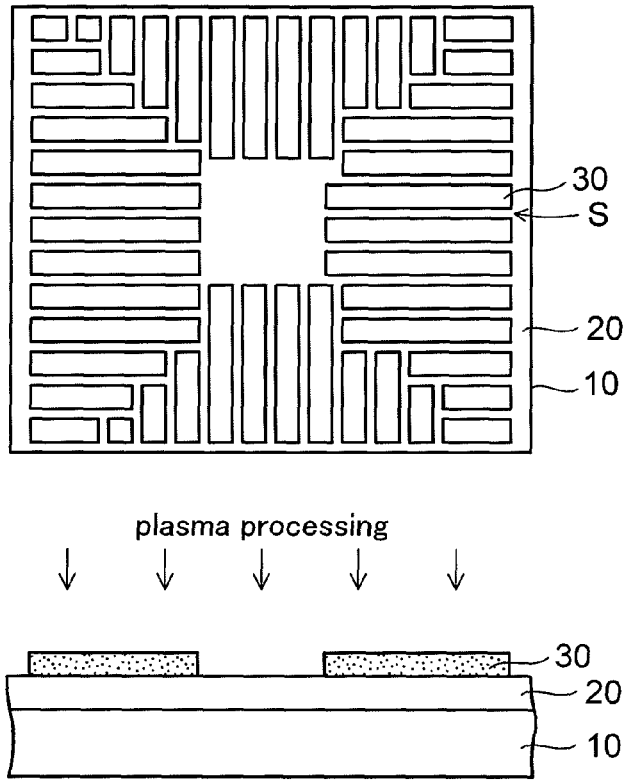
FIG. 4 is a plan view and a sectional view (#4) showing the method of manufacturing the inductor device according to the first embodiment of the present invention.

Then, as shown in FIG. 4, the first catalyst metal-containing resin pattern layers 30 are etched until a halfway position in thickness by the plasma processing such as the oxygen plasma, or the like. In the case that a film thickness of the first catalyst metal-containing resin pattern layer 30 is set to 5 μm, the first catalyst metal-containing resin pattern layer 30 is half-etched until that thickness is set to about 4 μm.

Accordingly, a surface density of the catalyst metal (palladium) can be increased in the surface layer portion of the first catalyst metal-containing resin pattern layer 30, and the surface which is suitable for the electroless plating can be obtained.

Figure 5:
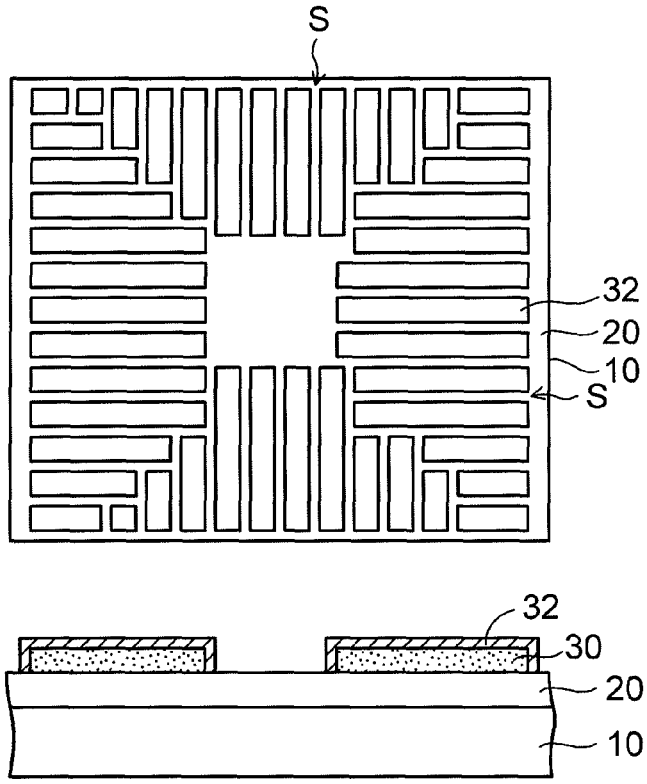
FIG. 5 is a plan view and a sectional view (#5) showing the method of manufacturing the inductor device according to the first embodiment of the present invention.

Then, as shown in FIG. 5, a first nickel (Ni) cobalt (Co) pattern layer 32 (magnetic body pattern layer) is formed on the first catalyst metal-containing resin pattern layers 30 by the electroless plating based on the catalytic action of the catalyst metal (palladium).

At this time, the first Ni Co pattern layer 32 is formed selectively only on the first catalyst metal-containing resin pattern layers 30. Accordingly, the first Ni Co pattern layers 32 are formed in the identical pattern with the first catalyst metal-containing resin pattern layers 30.

A film thickness of the first Ni Co pattern layer 32 is set to about 5 μm. Also, a content percentage of Co in the first Ni Co pattern layer 32 is set to 20 to 80%. Since the Ni Co layer has a high permeability (μ=5000), this Ni Co layer can be used suitably for the present embodiment. In this case, other magnetic materials may be employed.

Generally, the Ni Co layer has the film property that is hard to etch. Hence, in the processing by the etching, it is extremely hard to form the first Ni Co pattern layer 32 having thick film thickness with fine patterns.

However, by employing the above approach, the first Ni Co pattern layers 32 which are patterned and have arbitrary film thickness can be formed on the first catalyst metal-containing resin pattern layers 30 by the electroless plating not to etch the Ni Co layer.

Also, a pattern precision of the first Ni Co pattern layers 32 is decided by the first catalyst metal-containing resin pattern layers 30 formed by the photolithography. Therefore, the fine patterns can also be formed (e.g., line:space=30:30 μm to 50:50 μm).

Further, the first catalyst metal-containing resin pattern layers 30 serving as a seed layer in the electroless plating can be formed as a thin film (2 to 20 μm). Therefore, it is not feared that a level difference exerts a bad influence upon the later manufacturing process.

Figure 6:
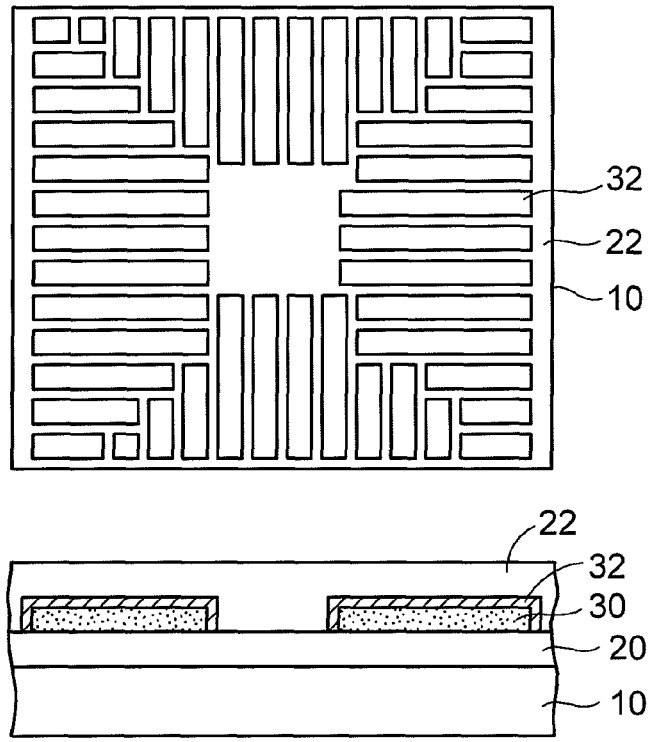
FIG. 6 is a plan view and a sectional view (#6) showing the method of manufacturing the inductor device according to the first embodiment of the present invention.

Then, as shown in FIG. 6, a second insulating layer 22 (lower insulating layer) is formed on the first insulating layer 20 and the first Ni Co pattern layers 32 by the similar forming method to the first insulating layer 20. In a plan view in FIG. 6, the second insulating layer 22 is depicted with the seeing through way.

Figure 7:
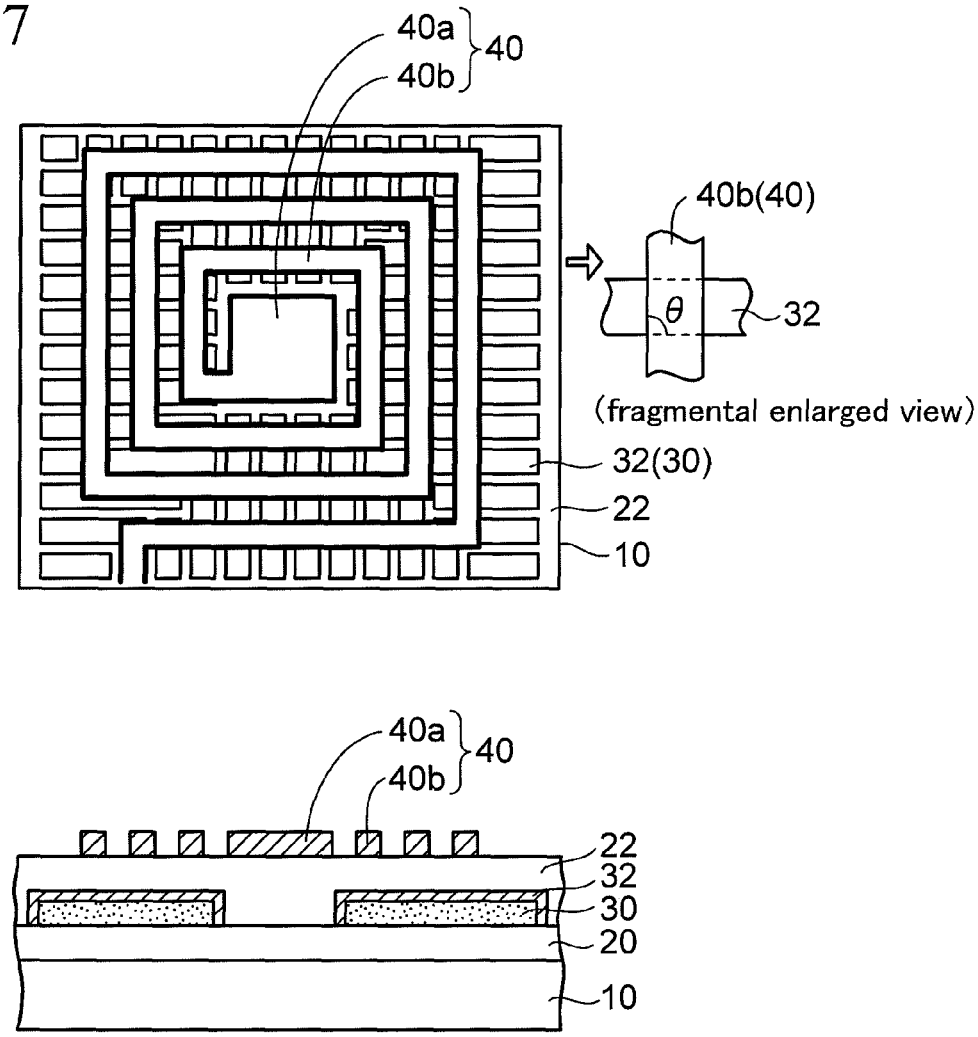
FIG. 7 is a plan view and a sectional view (#7) showing the method of manufacturing the inductor device according to the first embodiment of the present invention.

Then, as shown in FIG. 7, a first planar coil layer 40 (inductor pattern) whose film thickness is 5 to 30 μm is formed on the second insulating layer 22. Also, in a plan view in FIG. 7, the second insulating layer 22 is depicted with seeing through way.

The first planar coil layer 40 is constructed by a pad portion 40*a* arranged in the center portion, and a coil portion 40*b* extended spirally to the outward from the pad portion 40*a*. In the present embodiment, the coil portion 40*b* of the first planar coil layer 40 is formed to be wound spirally in a clockwise direction, and its outer shape is set to a square shape.

As described above, the first Ni Co pattern layers 32 are arranged such that their longer directions are directed to the lateral direction and the longitudinal direction of the substrate 10. As a result, the first Ni Co pattern layers 32 are arranged to intersect orthogonally with the first planar coil layer 40 which is wound in a square shape, respectively. That is, as shown in a fragmental enlarged view in FIG. 7, an intersecting angle θ in the part where the coil portion 40*b* of the first planer coil layer 40 and the first Ni Co pattern layers 32 intersect, is set to 90°.

The first planar coil layer 40 is formed by the semi-additive process, for example. In more detail explained, a seed layer (not shown) made of copper, or the like is formed on the second insulating layer 22, and then a plating resist (not shown) in which an opening portion is provided in the portion where the first planar coil layer 40 is to be arranged, is formed.

Then, a metal pattern layer formed of copper, or the like is formed in the opening portion of the plating resist by the electroplating utilizing the seed layer as a plating power feeding path. Then, the plating resist is removed, and then the seed layer is etched by using the metal pattern layer as a mask.

The first planar coil layer 40 is formed simultaneously with the wiring layers made of copper, or the like, which are built in the substrate 10. And the first planar coil layer 40 is formed such that the outer end of the coil portion 40*b* is connected to a predetermined wiring layer.

Figure 8:
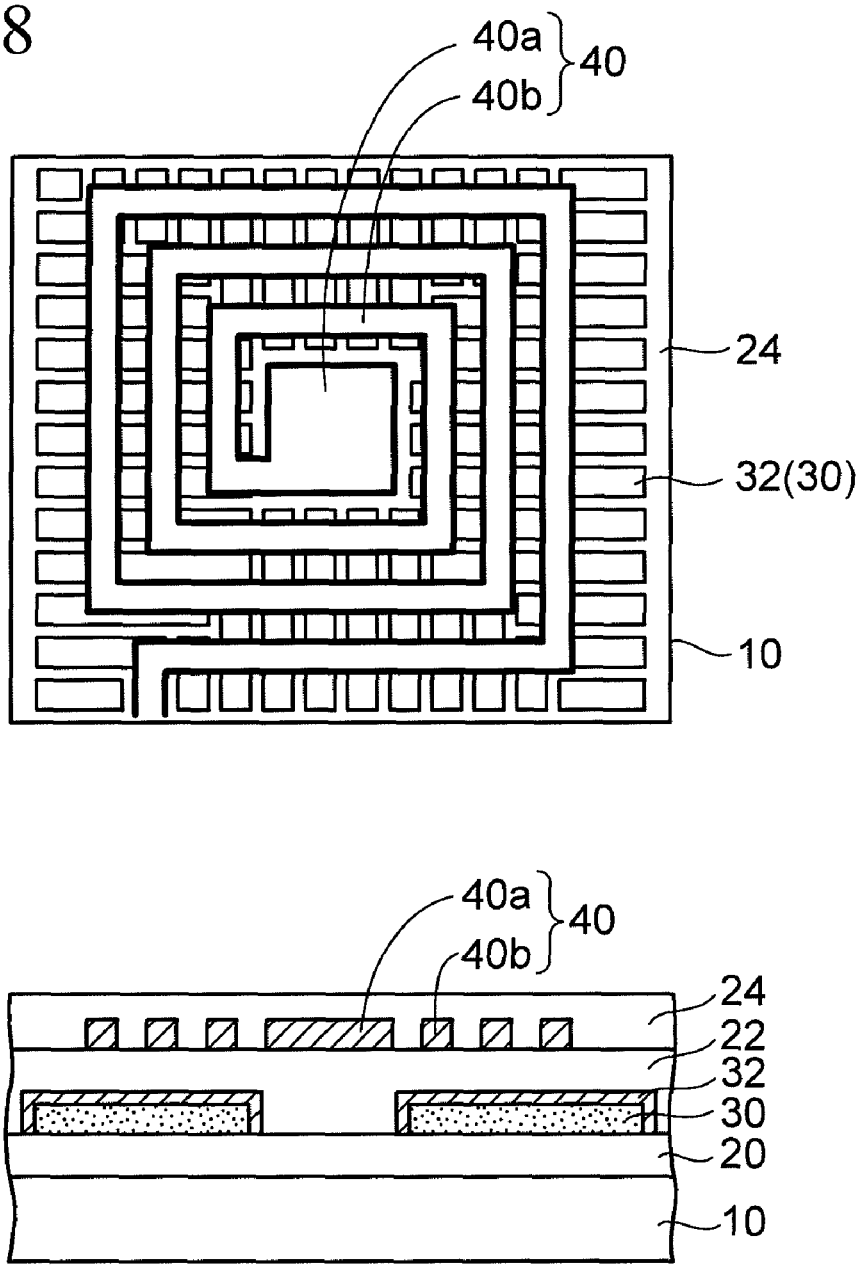
FIG. 8 is a plan view and a sectional view (#8) showing the method of manufacturing the inductor device according to the first embodiment of the present invention.

Then, as shown in FIG. 8, a third insulating layer 24 (intermediate insulating layer) is formed on the second insulating layer 22 and the first planar coil layer 40 by the similar forming method to the first insulating layer 20. In a plan view in FIG. 8, the third insulating layer 24 is depicted with the seeing through way.

Figure 9:
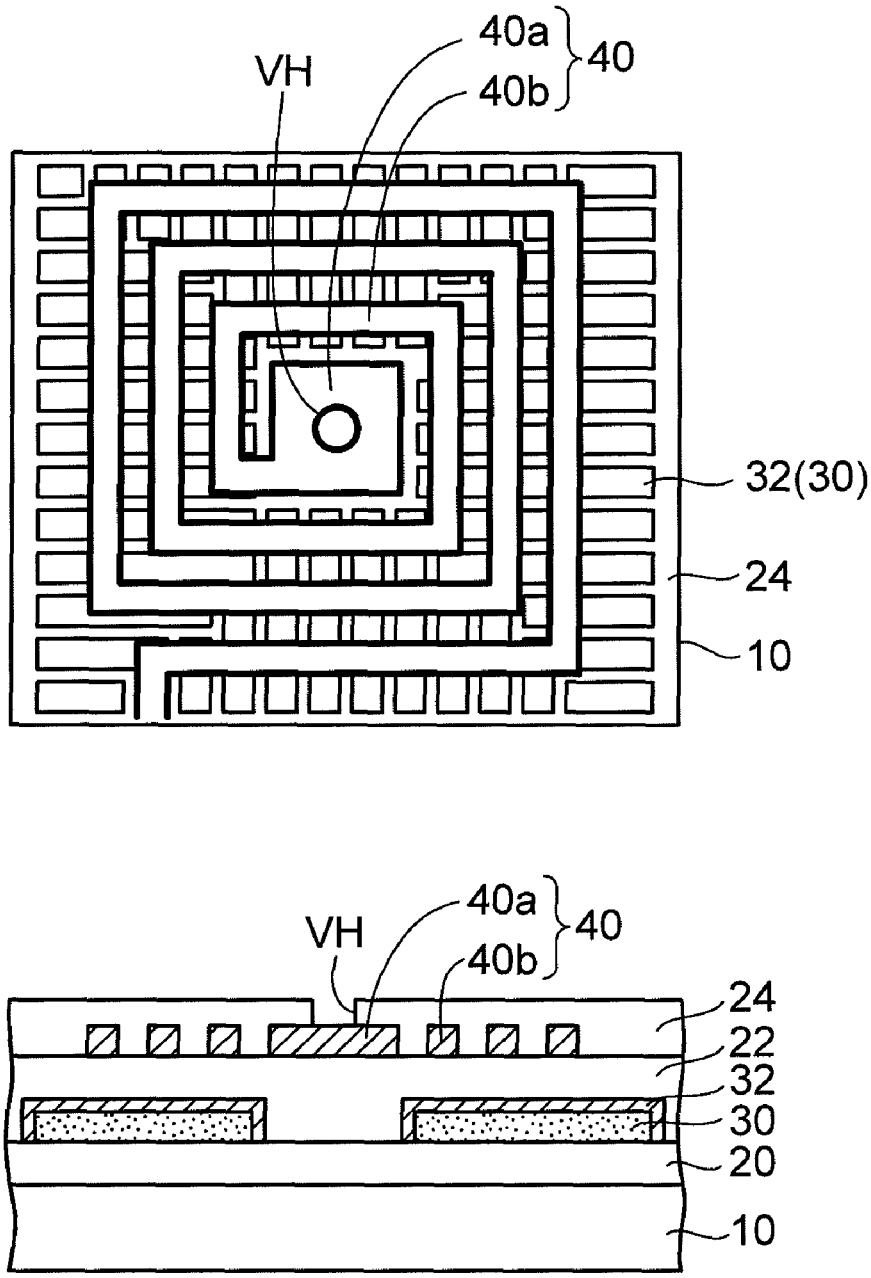
FIG. 9 is a plan view and a sectional view (#9) showing the method of manufacturing the inductor device according to the first embodiment of the present invention.

Then, as shown in FIG. 9, a via hole VH whose depth reaches the pad portion 40*a* of the first planar coil layer 40 is formed by applying the laser processing to the third insulating layer 24. In FIG. 9 also, the third insulating layer 24 is depicted with the seeing through way.

Figure 10:
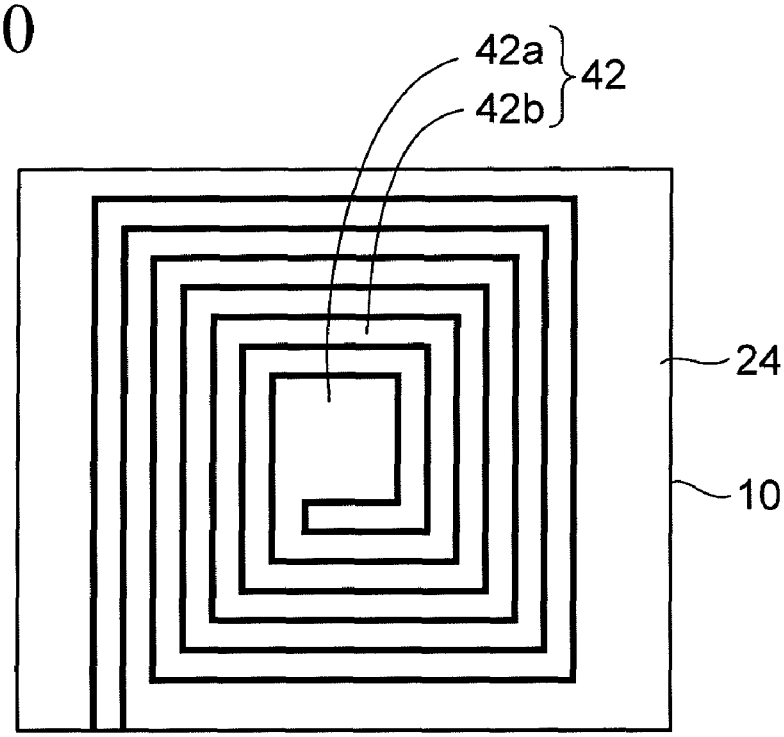
FIG. 10 is a plan view and a sectional view (#10) showing the method of manufacturing the inductor device according to the first embodiment of the present invention.
Figure 10:
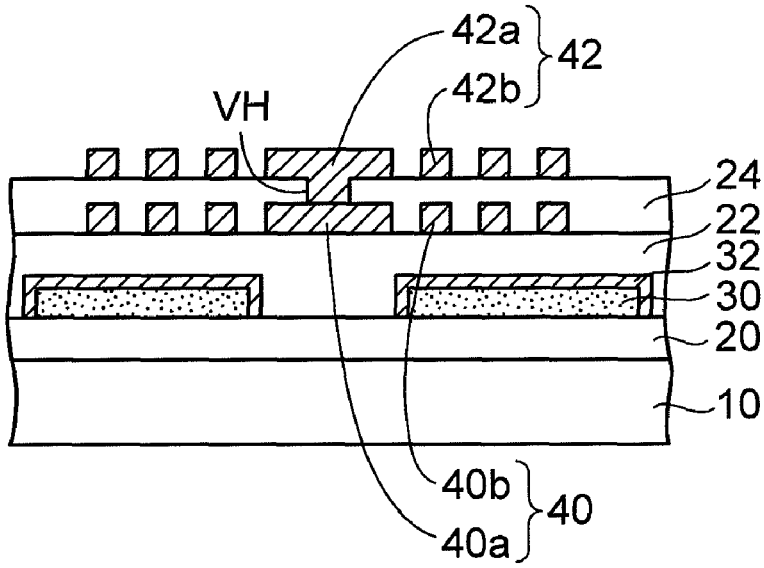

Then, as shown in FIG. 10, a second planar coil layer 42 (inductor pattern) is formed on the third insulating layer 24 by the similar forming method to the first planar coil layer 40. The second planar coil layer 42 is constructed by a pad portion 42*a* arranged in the center portion, and a coil portion 42*b* extended spirally to the outward from the pad portion 42*a*. The coil portion 42*b* of the second planar coil layer 42 is wound to the anticlockwise direction oppositely to the above described first planar coil layer 40.

Also, like the above first planar coil layer 40, the second planar coil layer 42 is wound with a square shape, and is arranged to intersect orthogonally with the first Ni Co pattern layer 32.

Then, the pad portion 42*a* of the second planar coil layer 42 is connected electrically to the pad portion 40*a* of the first planar coil layer 40 via the via hole VH (via conductor). The second planar coil layer 42 is also formed simultaneously with the built-in wiring layer made of copper, or the like, and the outer end of the coil portion 42*b* is formed to be connected to a predetermined wiring layer.

In this manner, the first and second planar coil layers 40, 42 are stacked in a state that these layers are connected mutually via the via hole VH (via conductor).

In the present embodiment, such a mode is illustrated that two first and second planar coil layers 40, 42 are stacked. In this case, the planar coil layers can be stacked via the insulating layer with n (n is an integer in excess of 2) stacked number such that the winding directions of the coils are reversed alternately. Otherwise, only one planar coil layer may be employed.

Figure 11:
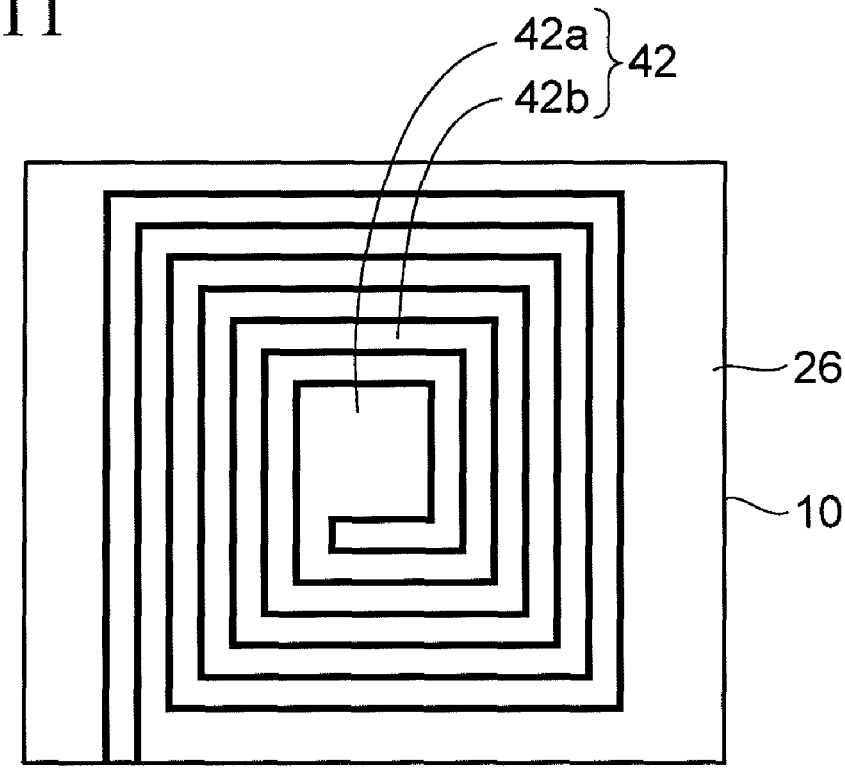
FIG. 11 is a plan view and a sectional view (#11) showing the method of manufacturing the inductor device according to the first embodiment of the present invention.
Figure 11:
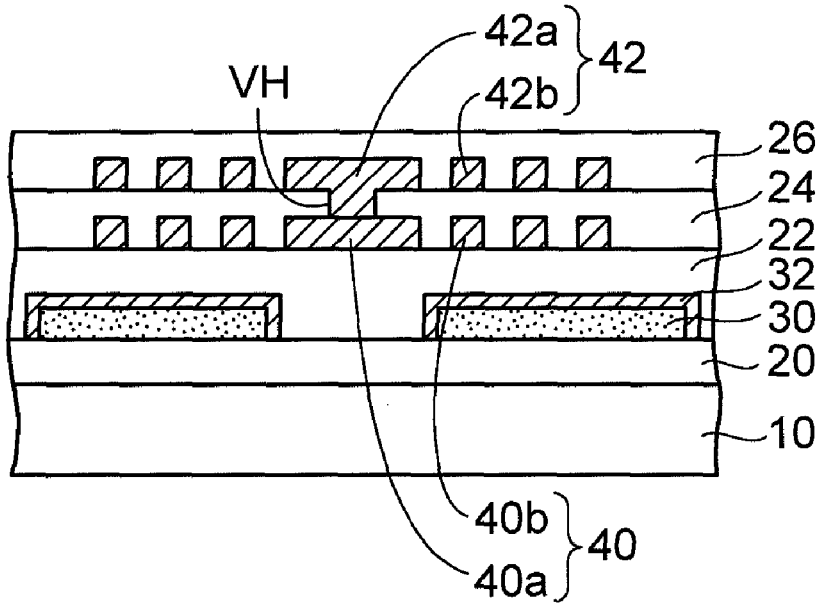

Then, as shown in FIG. 11, a fourth insulating layer 26 (upper insulating layer) is formed on the third insulating layer 24 and the second planar coil layer 42 by the similar forming method to the first insulating layer 20. In a plan view in FIG. 11, the fourth insulating layer 26 is depicted with the seeing through way.

Figure 12:
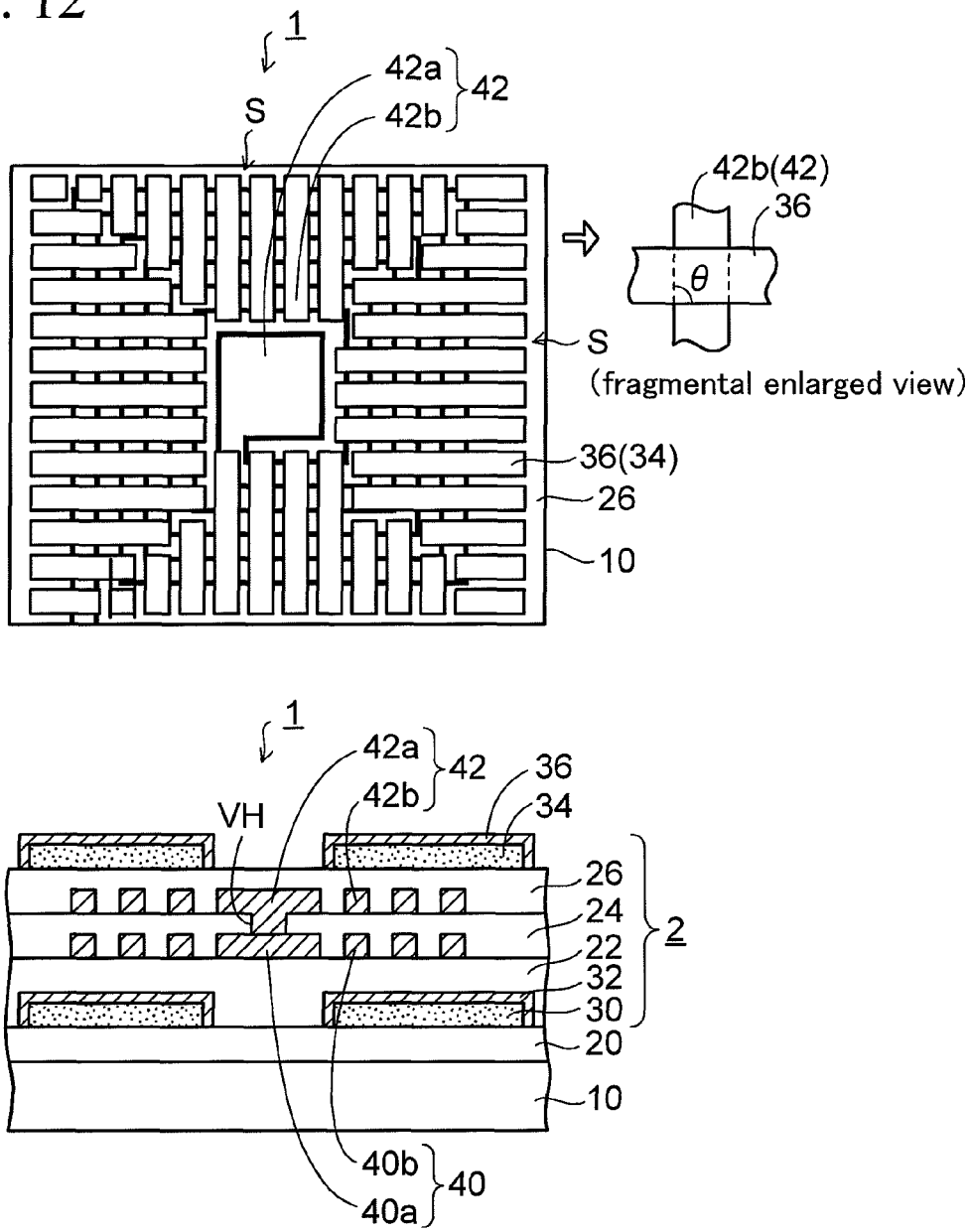
FIG. 12 is a plan view and a sectional view (#12) showing the method of manufacturing the inductor device according to the first embodiment of the present invention.

Then, as shown in FIG. 12, second catalyst metal-containing resin pattern layers 34 are formed on the fourth insulating layer 26 by the similar forming method to those in FIG. 3 and FIG. 4, and then are half-etched by the plasma processing.

The second catalyst metal-containing resin pattern layers 34 are formed in the identical pattern with the first catalyst metal-containing resin pattern layer 30. Then, a second Ni Co pattern layer 36 (magnetic body pattern layer) is selectively formed on the second catalyst metal-containing resin pattern layers 34 by the electroless plating.

The second Ni Co pattern layers 36 are arranged to intersect orthogonally with the coil portion 42*b* of the second planar coil layer 42 respectively.

That is, as shown in a fragmental enlarged view in FIG. 12, an intersecting angle θ in the part where the second Ni Co pattern layers 36 and the coil portion 42*b* of the second planar coil layer 42 intersect, is set to 90°. Also, it is of course that the second Ni Co pattern layers 36 are arranged to intersect orthogonally with the first planar coil layer 40.

With the above, an inductor device 1 of the first embodiment can be obtained.

As shown in FIG. 12, in the inductor device 1 in the first embodiment, the first insulating layer 20 is formed on the substrate 10. The first catalyst metal-containing resin pattern layers 30 and the first Ni Co pattern layers 32 formed thereon with the identical pattern by the electroless plating are formed on the first insulating layer 20.

The first Ni Co pattern layers 32 arranged on both sides of the lateral direction of the substrate are formed side by side such that their longer directions are directed to the lateral direction in a state that the slit S is provided between them respectively (see FIG. 5). Also, the first Ni Co pattern layers 32 arranged on both sides of the longitudinal direction of the substrate 10 are formed side by side such that their longer directions are directed to the longitudinal direction in a state that the slit S is provided between them respectively (see FIG. 5).

Also, the second insulating layer 22 (lower insulating layer) is formed on the first Ni Co pattern layers 32 and the first insulating layer 20. The first planar coil layer 40 constructed by the pad portion 40*a* and the coil portion 40*b*, which is connected to the pad portion 40*a* and is wound spirally to the clockwise direction, is formed on the second insulating layer 22. The coil portion 40*b* of the first planar coil layer 40 is arranged such that this coil portion is wound with a square shape.

Accordingly, the first planar coil layer 40 and the first Ni Co pattern layers 32 are arranged to intersect orthogonally (see FIG. 7).

The third insulating layer 24 (intermediate insulating layer) is formed on the first planar coil layer 40 and the second insulating layer 22. The via hole VH whose depth reaches the pad portion 40*a* of the first planar coil layer 40 is formed in the third insulating layer 24.

Also, the second planar coil layer 42 constructed by the pad portion 42*a*, and the coil portion 42*b*, which is connected to the pad portion 42*a* and is wound spirally to the anticlockwise direction, is formed on the third insulating layer 24. The pad portion 42*a* of the second planar coil layer 42 is connected electrically to the pad portion 40*a* of the first planar coil layer 40 via the via hole VH (via conductor). The coil portion 42*b* of the second planar coil layer 42 is arranged such that this coil portion is wound with a square shape.

Also, the fourth insulating layer 26 (upper insulating layer) is formed on the second planar coil layer 42 and the third insulating layer 24. The second catalyst metal-containing resin pattern layers 34 and the second Ni Co pattern layers 36, which are formed thereon with the identical pattern by the electroless plating, are formed on the fourth insulating layer 26. The second Ni Co pattern layers 36 are patterned in the identical pattern with the first Ni Co pattern layer 32 in a state that the slits S are provided.

Accordingly, the first and second planar coil layers 40, 42, and the second Ni Co pattern layers 36 are arranged to intersect orthogonally.

In this manner, an inductor device 2 is constructed by stacking the first Ni Co pattern layer 32, the first and second planar coil layers 40, 42, and the second Ni Co pattern layers 36 via the insulating layers 22, 24, 26.

In the inductor device 1 in the first embodiment, the first and second Ni Co pattern layers 32, 36 are arranged to upper and lower side of the first and second planar coil layers 40, 42 respectively. As a result, in the case that the inductor device is applied to the printed wiring board, the EMI noise can be reduced and high reliability can be obtained, and also an inductance of an inductor element 2 can be increased.

Also, the first and second Ni Co pattern layers 32, 36 are patterned such that the slit S is provided between them respectively. Therefore, generation of an eddy current can be suppressed rather than the case where the Ni Co layer is formed on the whole surface. When the eddy current is generated, an efficiency of the inductor is lowered and the enough performance cannot be delivered. For this reason, it is important to suppress the eddy current.

Further, the first and second Ni Co pattern layers 32, 36 are arranged to intersect orthogonally with the first and second planar coil layers 40, 42 respectively. Therefore, generation of the eddy current can be suppressed further in contrast to the case where these pattern layers are not intersected orthogonally with the coil layers.

The eddy current flows as crossed to the direction of the current that flows into the first and second planar coil layers 40, 42. Therefore, the first and second Ni Co pattern layers 32, 36 between which the slit S is provided respectively are arranged to intersect orthogonally with the first and second planar coil layers 40, 42 respectively, and as a result the generation of the eddy current can be suppressed effectively.

Also, the magnetic field generated by flowing the current to the first and second planar coil layers 40, 42 is generated to the right-angled direction to the direction of the flowing current. Therefore, from a viewpoint of not disturbing the generation of the magnetic field, such an arrangement is reasonable that the first and second Ni Co pattern layers 32, 36 between which the slit S is provided respectively are positioned to intersect orthogonally with the first and second planar coil layers 40, 42 respectively.

Also, in the inductor device 1 in the present embodiment, the inductor element 2 is built in the substrate 10 (the printed wiring board, or the like) by the thin film process. Therefore, a thinner type can be attained rather than the case where the inductor component whose height is high is mounted. Also, since the planar coil layers can be stacked, a mounting area can be reduced rather than the case where the inductor component is mounted.

Also, even when the inductor device is applied to the high-frequency circuit, there is no necessity that the inductor component which is designed particularly for high-frequency purpose should be employed. Therefore, a manufacturing cost can be reduced.

In the present embodiment, such an example is illustrate that the wound shapes of the first and second planar coil layers 40, 42 are set to a square shape respectively, and the first and second Ni Co pattern layers 32, 36 are arranged to intersect orthogonally with the first and second planar coil layers 40, 42 respectively.

As other modes, the wound shapes of the first and second planar coil layers 40, 42 may be set to a polygonal shape more than a quadrangular shape, such as a pentagonal shape, a hexagonal shape, a heptagonal shape, an octagonal shape, or the like, or a circular shape respectively. In this case, in compliance with the wound shapes of the first and second planar coil layers 40, 42, the arrangement of the first and second Ni Co pattern layers 32, 36 is adjusted so as to intersect orthogonally with the first and second planar coil layers 40, 42 respectively. In other modes, the similar advantages can be achieved.

Second Embodiment

FIGS. 13A to 13D, FIGS. 14A and 14B, FIG. 15, and FIG. 16 are sectional views showing a method of manufacturing an inductor device according to a second embodiment of the present invention respectively. A feature of the second embodiment resides in that the first and second Ni Co pattern layers arranged to the upper and lower side are brought partially close to each other by providing the holes in the insulating layer, thereby a magnetic coupling is increased.

Figure 13A:
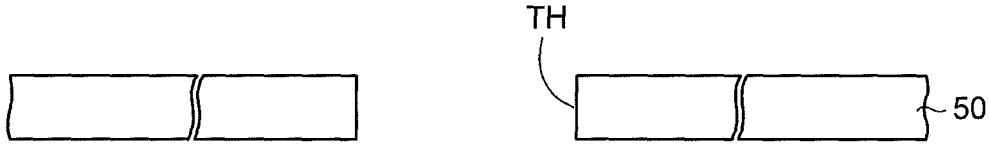
FIGS. 13A to 13D are sectional views (#1) showing a method of manufacturing an inductor device according to a second embodiment of the present invention.

In the method of manufacturing the inductor device in the second embodiment, as shown in FIG. 13A, first, an insulating substrate 50 (intermediate insulating layer) whose thickness is 100 to 150 μm is prepared. Then, a through hole TH which penetrates to the thickness direction is formed in the insulating substrate 50 by the drilling, or the like.

Figure 13B:
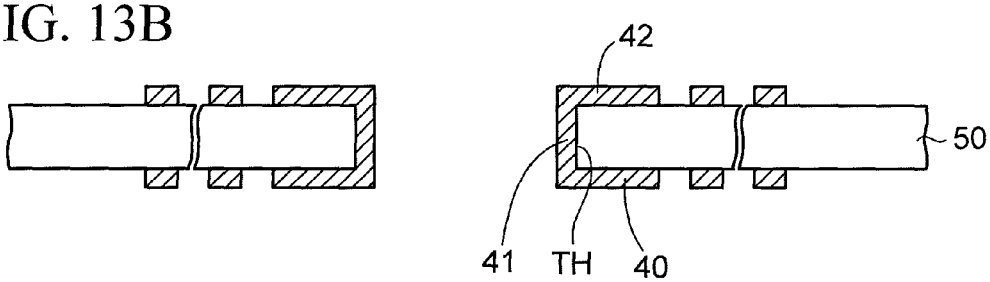

Then, as shown in FIG. 13B, the first and second planar coil layers 40, 42 made of copper, or the like are formed on both surface sides of the insulating substrate 50 on the basis of the plating method respectively. The first planar coil layer 40 located on the lower surface side and the second planar coil layer 42 located on the upper surface side are formed to be connected to a via conductor 41 formed on the side surface of the through hole TH respectively, and are connected mutually via the via conductor 41.

Figure 15:
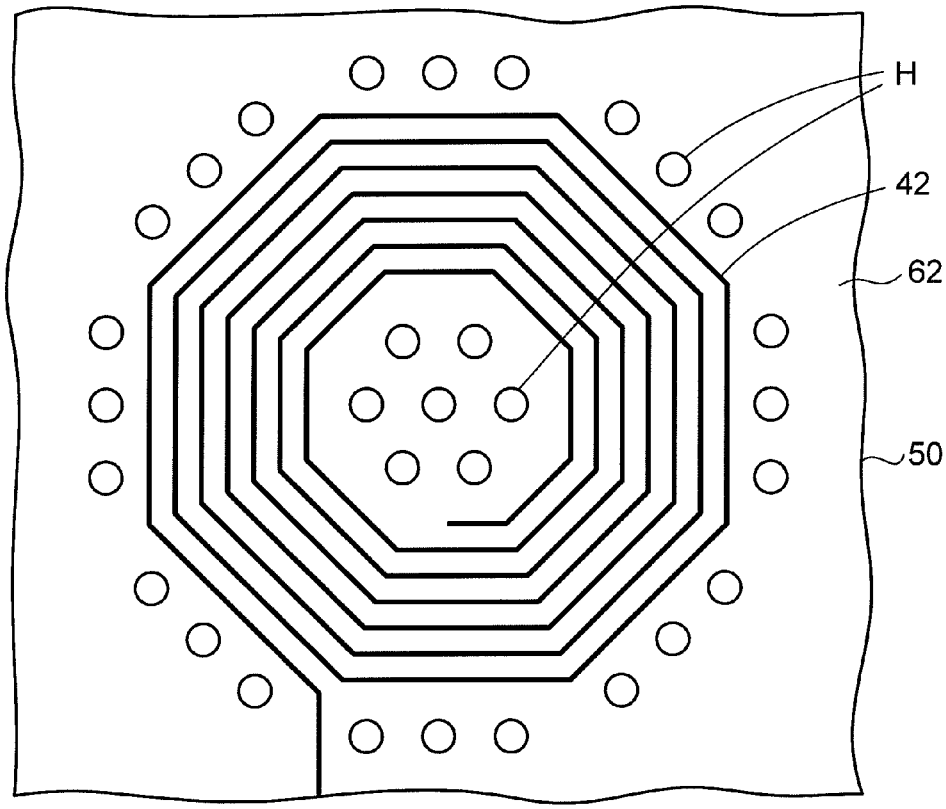
FIG. 15 is a plan view showing a state of a planar coil layer and holes in the upper surface side of the inductor device in the second embodiment of the present invention.

As shown in a plan view in FIG. 15, the second planar coil layer 42 located on the upper surface side of the insulating substrate 50, whose wound shape is an octagonal shape, and is formed to be wound in the anticlockwise direction. The first planar coil layer 40 located on the lower surface side is formed to be wound in an octagonal shape in the opposite direction to the winding direction of the second planar coil layer 42. Like the first embodiment, the first and second planar coil layers 40, 42 are formed simultaneously with the built-in wiring made of copper, or the like, and the outer ends thereof are formed to be connected to the predetermined wiring layers.

Figure 13C:
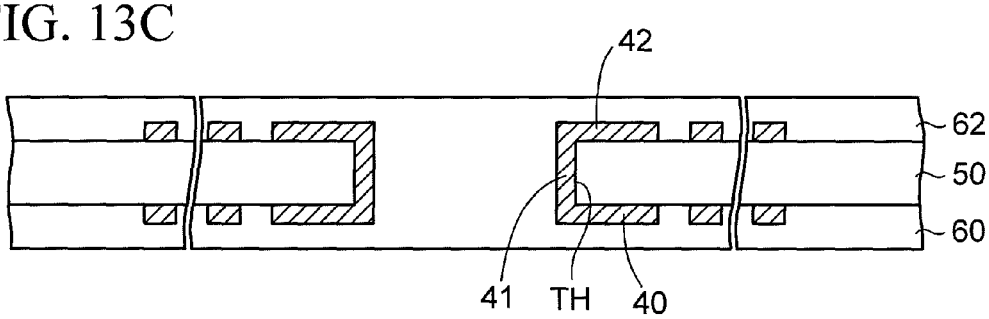

Then, as shown in FIG. 13C, a first insulating layer 60 (lower insulting layer) for covering the first planar coil layer 40, and a second insulating layer 62 (upper insulting layer) for covering the second planar coil layer 42 are formed by pasting a resin film on both surfaces of the insulating substrate 50, or the like respectively. At this time, the through hole TH in the insulating substrate 50 is filled with the first and second insulating layers 60, 62.

Figure 13D:
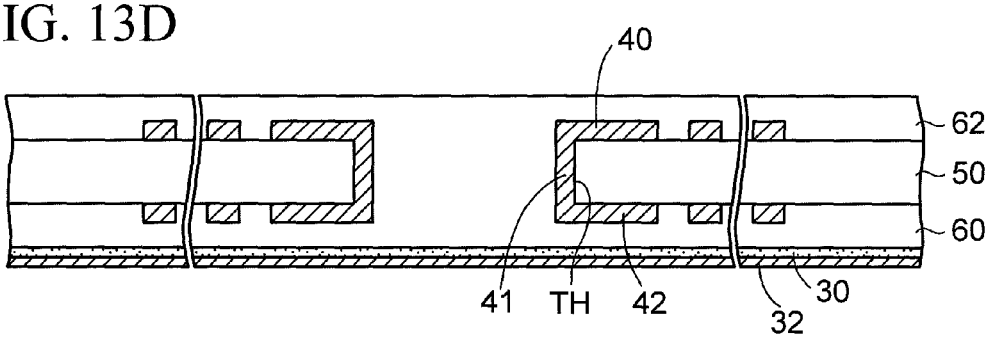

Then, as shown in FIG. 13D, by the similar method to those in FIG. 3 and FIG. 4 in the first embodiment, the first catalyst metal-containing resin pattern layer 30 is formed on the first insulating layer 60 on the lower surface side of the insulating substrate 50, and then this first catalyst metal-containing resin pattern layer 30 is half-etched by the plasma processing. Also, the first Ni Co layers 32 (magnetic body pattern layer) are formed selectively on the first catalyst metal-containing resin pattern layer 30 by the electroless plating.

The first Ni Co layers 32 are arranged to intersect orthogonally with the first and second planar coil layers 40, 42 which are formed in an octagonal shape.

Figure 14A:
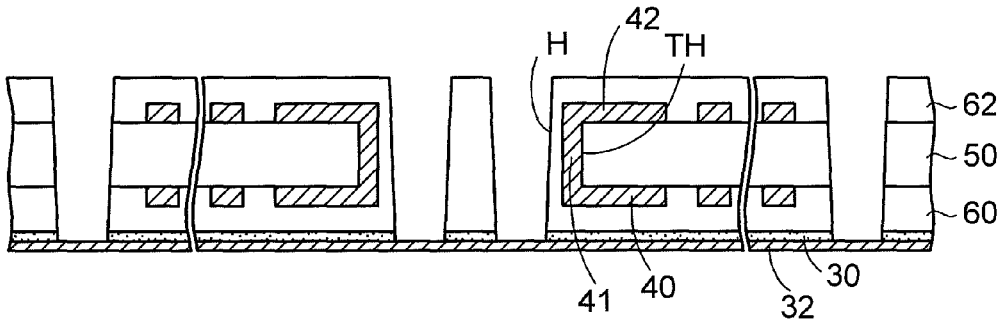
FIGS. 14A and 14B are sectional views (#2) showing the method of manufacturing the inductor device according to the second embodiment of the present invention.

Then, as shown in FIG. 14A, holes H whose depth reaches the first Ni Co layers 32 are formed by applying the laser processing to the second insulating layer 62, the insulating substrate 50, the first insulating layer 60, and the first catalyst metal-containing resin pattern layer 30. As shown in a plan view in FIG. 15, the holes H are arranged with plural in the center portions of the first and second planar coil layers 40, 42 (in the through hole TH in the insulating substrate 50), and also are arranged side by side like a ring shape in the outer peripheral portion.

Figure 14B:
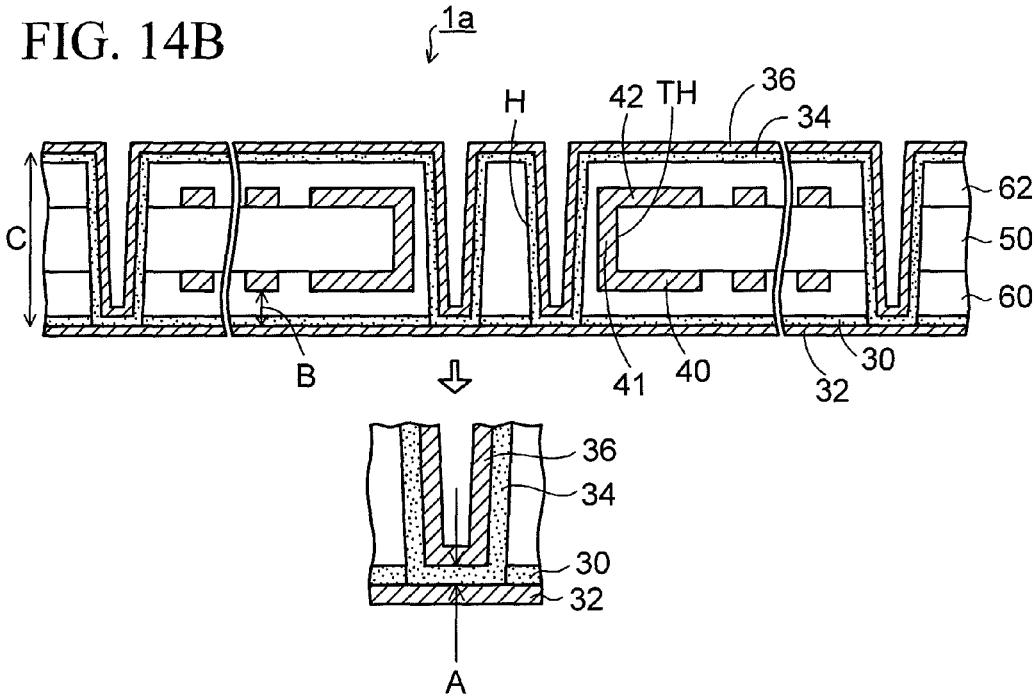

Then, as shown in FIG. 14B, by the similar method to those in FIG. 3 and FIG. 4 in the first embodiment, the second catalyst metal-containing resin pattern layer 34 is formed on the second insulating layer 62 on the upper surface side of the insulating substrate 50 and on inner surfaces of the holes H, and is half-etched by the plasma processing. Also, the second Ni Co pattern layer 36 (magnetic body pattern layer) is formed selectively on the second catalyst metal-containing resin pattern layer 34 by the electroless plating.

The second Ni Co pattern layers 36 are arranged to intersect orthogonally with the first and second planar coil layers 40, 42 which are formed in an octagonal shape respectively.

With the above, an inductor device la in the second embodiment can be obtained.

As shown in FIG. 14B, in the inductor device la in the second embodiment, the first catalyst metal-containing resin pattern layer 30 and the first Ni Co pattern layer 32 arranged with the identical pattern under this layer are formed at the lowermost position. The first insulating layer 60 (lower insulating layer) is formed on the first catalyst metal-containing resin pattern layer 30.

The insulating substrate 50 (intermediate insulating layer) in which the through hole TH is provided is formed on the first insulating layer 60. The first and second planar coil layers 40, 42 connected mutually via the via conductor 41 formed on the side surface of the through hole TH are formed on both surface sides of the insulating substrate 50 respectively.

By reference to FIG. 15 together, the second planar coil layer 42 has the structure whose wound shape is the octagonal shape. Although not particularly shown, the first planar coil layer 40 also has the structure whose wound shape is the octagonal shape, and is wound in the opposite direction to the second planar coil layer 42.

The second insulating layer 62 (upper insulating layer) for covering the second planar coil layer 42 is formed on the upper surface side of the insulating substrate 50. The through hole TH in the insulating substrate 50 is filled with the first and second insulating layers 60, 62.

Also, the hole H whose depth reaches the first Ni Co pattern layer 32 is formed in the second insulating layer 62, the insulating substrate 50, the first insulating layer 60, and the first catalyst metal-containing resin pattern layer 30. Also, the second catalyst metal-containing resin pattern layer 34 and the second Ni Co pattern layers 36 arranged thereon with the identical pattern are formed on the second insulating layer 62 and on the inner surface of the hole H.

Figure 16:
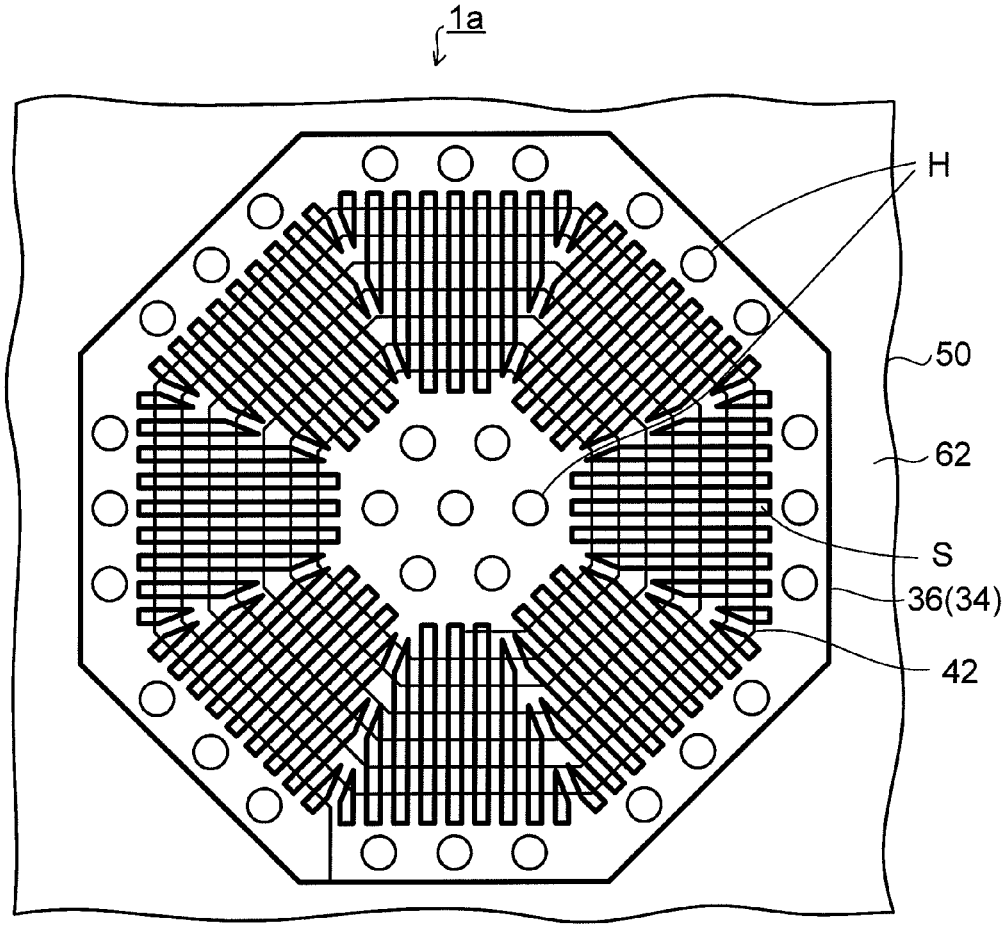
FIG. 16 is a plan view showing of the inductor device in FIG. 14B when viewed from the upper side.

In FIG. 16, a plan view of a structure in FIG. 14B when viewed from the upper side is shown. As shown in FIG. 16, the second Ni Co pattern layer is patterned above the second planar coil layer 42 which is formed in an octagonal shape such that the slits S provided in the inside are arranged to intersect orthogonally with the second planar coil layer 42.

That is, the second Ni Co pattern layers 36 are formed to be connected as a single layer in a state that the slits S are provided therein, and the patterns thereof are arranged to extend to the center portion and the outer peripheral portion of the second planar coil layer 42.

The first Ni Co pattern layers 32 located on the lower surface side, described above, are also formed in the similar pattern to those of the second Ni Co pattern layers 36.

In FIG. 14B, when the bottom surface of the hole H is focused (fragmental enlarged view), the second catalyst metal-containing resin pattern layer 34 formed as a thin film intervenes between the second Ni Co pattern layers 36 and the first Ni Co pattern layers 32. That is, a first insulating gap A which is formed of the second catalyst metal-containing resin pattern layer 34 is provided between the second Ni Co pattern layers 36 and the first Ni Co pattern layers 32.

A distance (thickness) of this first insulating gap A is set shorter (thinner) than a distance (thickness) of a second insulating gap B (a total film thickness of the first insulating layer 60 and the first catalyst metal-containing resin pattern layer 30) between the lower surface of the first planar coil layer 40 and the upper surface of the first Ni Co pattern layers 32.

An inductor device 1*a* in the second embodiment can achieve the similar advantages to those of the first embodiment. In addition to this, following advantages can be achieved.

As the factors which make the magnetic coupling of the inductor predominate, firstly, the coupling at the area where the distance is the shortest is given priority, and secondly, the coupling with the material whose permeability is high is given priority.

Therefore, in order to make the magnetic field generated around the first and second planar coil layers 40, 42 circulate smoothly, the first and second Ni Co pattern layers 32, 36 may be formed to cover the peripheries of the first and second planar coil layers 40, 42 (FIG. 16).

At the same time, the distance between the first and second Ni Co pattern layers 32, 36 (the first insulating gap A) may be set shorter than the distance between the first planar coil layer 40 and the first Ni Co pattern layers 32 (the second insulating gap B) by forming the hole H (FIG. 14B).

As a result, such a structure is obtained that the magnetic coupling between the upper and lower surface sides can be enhanced because a magnetic resistance is decreased and at the same time the magnetic saturation is hard to occur because the first insulating gap A exists between the first and second Ni Co pattern layers 32, 36.

Unlike the present embodiment, in the case that the distance between the first and second Ni Co pattern layers 32, 36 (the first insulating gap A) is set to zero in the holes H, the magnetic saturation easily occurs.

Also, in the case that the holes H are not formed, the distance between the first and second Ni Co pattern layers 32, 36 is given by a total film thickness of the first and second catalyst metal-containing resin pattern layers 30, 34, the first and second insulating layers 60, 62, and the insulating substrate 50 (a third insulating gap C in FIG. 14B), and thus is increased largely. Therefore, the magnetic body layer having the high permeability more than a predetermined value must be employed, and the material of the magnetic body layer is restricted.

In this case, in an example in FIG. 16, the first and second Ni Co pattern layers 32, 36 are arranged in the whole of the outer peripheral portions of the first and second planar coil layers 40, 42 like a ring respectively. In this case, the holes H may be arranged collectively at the four corner portions, and the triangular first and second Ni Co pattern layers 32, 36 may be extended to the four corner portions.

Also, in an example in FIG. 16, the holes H are arranged in the center portion and the outer peripheral portions of the first and second planar coil layers 40, 42, and the first and second Ni Co pattern layers 32, 36 are arranged to extend to the center portion and the outer peripheral portions of the first and second planar coil layers 40, 42.

The present invention is not restricted to this mode, and the holes H may be arranged in any area except the first and second planar coil layers 40, 42. Such a structure may be formed that the first and second Ni Co pattern layers 32, 36 are arranged to come partially close to each other via the first insulating gap A.

Also, the holes H are not always formed to reach the first Ni Co pattern layer 32. The holes H may be formed until a halfway position in thickness of the first insulating layer 60 such that the first insulating gap A explained previously in FIG. 14B becomes shorter than the second insulating gap B.

Also, the similar structure may be formed by forming the similar holes H in the above inductor device 1 in the first embodiment. In this case, in the foregoing first embodiment, the pad portions 40*a*, 42*a* of the first and second planar coil layers 40, 42 are omitted, the via conductor is provided on the side surface of the via hole VH whose diameter having a size correspond to the pad portions 40*a*, 42*a*, and the first and second planar coil layers 40, 42 are connected mutually.

What is claimed is:

1. An inductor device, comprising:

a first magnetic body pattern layer in which slits are provided and which is made to a pattern;

a lower insulating layer formed on the first magnetic body pattern layer;

a planar coil layer formed on the lower insulating layer;

an upper insulating layer formed on the planar coil layer; and a second magnetic body pattern layer formed on the upper insulating layer, and in which slits are provided and which is made to a pattern;

wherein the first magnetic body pattern layer and the second magnetic body pattern layer are arranged to intersect orthogonally with the planar coil layer, wherein the first magnetic body pattern layer and the second magnetic body pattern layer are spaced apart from each other.

2. An inductor device according to claim 1, wherein the first magnetic body pattern layer and the second magnetic body pattern layer are formed of a nickel cobalt layer, which is formed on a catalyst metal-containing resin pattern layer by an electroless plating.

3. An inductor device according to claim 1, wherein the first magnetic body pattern layer is formed on a substrate.

4. An inductor device according to claim 1, wherein the planar coil layer is stacked with n layers (n is an integer of 2 or more) via an intermediate insulating layer, and the upper and lower planar coil layers are connected electrically via a via conductor which is formed in the intermediate insulating layer.

5. An inductor device according to claim 1, wherein a wound shape of the planar coil layer is formed of a polygonal shape in a quadrangular shape or more, or a circular shape.

6. An inductor device, comprising:

a first magnetic body pattern layer in which slits are provided and which is made to a pattern;

a lower insulating layer formed on the first magnetic body pattern layer;

a planar coil layer formed on the lower insulating layer;

an upper insulating layer formed on the planar coil layer; and a second magnetic body pattern layer formed on the upper insulating layer, and in which slits are provided and which is made to a pattern;

wherein the first magnetic body pattern layer and the second magnetic body pattern layer are arranged to intersect orthogonally with the planar coil layer, wherein the planar coil layer is stacked with n layers (n is an integer of 2 or more) via an intermediate insulating layer, and the upper and lower planar coil layers are connected electrically via a via conductor which is formed in the intermediate insulating layer, further comprising:

a hole formed in an area except the planar coil layer from an upper surface of the upper insulating layer to a depth direction;

wherein the second magnetic body pattern layer is formed on the upper insulating layer and an inner surface of the hole in a state that the second magnetic body pattern layer is extended from an area of the planar coil layer, and a first insulating gap which is provided between the second magnetic body pattern layer arranged at a bottom of the hole and the first magnetic body pattern layer is set shorter than a second insulating gap which is provided between the planar coil layer and the first magnetic body pattern layer.

7. A method of manufacturing an inductor device, comprising the steps of:

forming a first magnetic body pattern layer, in which slits are provided and which is made to a pattern, on a substrate;

forming a lower insulating layer on the first magnetic body pattern layer;

forming a planar coil layer on the lower insulating layer;

forming an upper insulating layer on the planar coil layer; and forming a second magnetic body pattern layer, in which slits are provided and which is made to a pattern, on the upper insulating layer;

whereby the first magnetic body pattern layer and the second magnetic body pattern layer are arranged to intersect orthogonally with the planar coil layer, wherein the first magnetic body pattern layer and the second magnetic body pattern layer are spaced apart from each other.

8. A method of manufacturing an inductor device, according to claim 7, wherein the step of forming the first magnetic body pattern layer and the step of forming the second magnetic body pattern layer includes respectively the steps of:

forming a catalyst metal-containing resin pattern layer which is made to a pattern for an electroless plating, and forming the magnetic body pattern layer selectively on the catalyst metal-containing resin pattern layer by the electroless plating.

* * * * *